US008418457B2

(12) United States Patent
Schmidt

(10) Patent No.: US 8,418,457 B2
(45) Date of Patent: Apr. 16, 2013

(54) APPLICATION OF MICROTURBINES TO CONTROL EMISSIONS FROM ASSOCIATED GAS

(75) Inventor: Darren D. Schmidt, Thompson, ND (US)

(73) Assignee: Energy & Enviromental Research Center Foundation, Grand Forks, ND (US)

( * ) Notice: Subject to any disclaimer, the term of this patent is extended or adjusted under 35 U.S.C. 154(b) by 666 days.

(21) Appl. No.: 12/184,860

(22) Filed: Aug. 1, 2008

(65) Prior Publication Data

US 2009/0031708 A1 Feb. 5, 2009

Related U.S. Application Data

(60) Provisional application No. 60/953,290, filed on Aug. 1, 2007.

(51) Int. Cl.
*F02C 1/00* (2006.01)
*F02B 27/00* (2006.01)

(52) U.S. Cl.
USPC ..... 60/597; 60/273; 60/685; 60/772

(58) Field of Classification Search ..... 60/286, 60/323.1, 273, 772, 685, 597; 96/155, 218, 96/219, 380; 95/39, 41, 42, 90, 149, 273
See application file for complete search history.

(56) References Cited

U.S. PATENT DOCUMENTS 3,341,185 A * 9/1967 Kennedy, Sr. ..... 261/41.4
3,935,708 A * 2/1976 Harrewijne et al. ..... 60/517
4,342,192 A 8/1982 Heyn et al.
5,500,306 A * 3/1996 Hsu et al. ..... 429/401
7,017,330 B2 3/2006 Bellows
(Continued)

FOREIGN PATENT DOCUMENTS

| | | |
|---|---|---|
| CA | 2707363 | 6/2012 |
| JP | 09-256812 | 9/1997 |
| KR | 1020020052209 | 7/2002 |
| WO | WO-2009018539 A3 | 2/2009 |

OTHER PUBLICATIONS

International Search Report, International Application No. PCT/US2008/071986, dated Jan. 30, 2009.
"Canadian Application Serial No. 2,707,363, First Examiners Report Received Jun. 16, 2011", 2 pgs.

*Primary Examiner* — Duane Smith
(74) *Attorney, Agent, or Firm* — Schwegman Lundberg & Woessner, P.A.

(57) ABSTRACT

A system for controlling the emission of associated gas produced from a reservoir. In an embodiment, the system comprises a gas compressor including a gas inlet in fluid communication with an associated gas source and a gas outlet. The gas compressor adjusts the pressure of the associated gas to produce a pressure-regulated associated gas. In addition, the system comprises a gas cleaner including a gas inlet in fluid communication with the outlet of the gas compressor, a fuel gas outlet, and a waste product outlet. The gas cleaner separates at least a portion of the sulfur and the water from the associated gas to produce a fuel gas. Further, the system comprises a gas turbine including a fuel gas inlet in fluid communication with the fuel gas outlet of the gas cleaner and an air inlet. Still further, the system comprises a choke in fluid communication with the air inlet.

12 Claims, 2 Drawing Sheets

U.S. PATENT DOCUMENTS 7,124,591 B2 * 10/2006 Baer et al. ..... 60/786
7,293,414 B1 * 11/2007 Huber ..... 60/682
7,442,239 B2 * 10/2008 Armstrong et al. ..... 96/155
2003/0057293 A1 * 3/2003 Boecking ..... 239/88

* cited by examiner

APPLICATION OF MICROTURBINES TO CONTROL EMISSIONS FROM ASSOCIATED GAS

CROSS-REFERENCE TO RELATED APPLICATIONS

This application claims benefit of U.S. provisional application Ser. No. 60/953,290 filed Aug. 1, 2007, and entitled "Application of Microturbines to Control Emissions From Associated Gas," which is hereby incorporated herein by reference in its entirety.

STATEMENT REGARDING FEDERALLY SPONSORED RESEARCH OR DEVELOPMENT

This invention was made with Government support under DE-FC26-98FT40320 awarded by the Department of Energy. The Government may have certain rights in the invention.

BACKGROUND

1. Field of the Invention

The invention relates generally to the control of emissions from associated gas. More particularly, the invention relates to energy generation and the control of emissions from associated gas by the use of microturbines adapted to utilize both high-heating-value gas and low-heating-value gas.

2. Background of the Invention

Hydrocarbon gases are almost always associated with crude oil in an oil reserve, as they represent the lighter chemical fraction (shorter molecular chain) formed when organic remains are converted into hydrocarbons. Such hydrocarbon gases may exist separately from the crude oil in the underground formation or be dissolved in the crude oil. As the crude oil is raised from the reservoir to the surface, pressure is reduced to atmospheric, and the dissolved hydrocarbon gases come out of solution. Such gases occurring in combination with produced crude oil are often referred to as "associated" or "casinghead" gas.

Although associated gas contains energy in the form of combustible hydrocarbons, it is typically not utilized because facility upgrade costs necessary to convert the energy into a usable form and distribution costs limit economic recovery. Consequently, in many production operations, the associated gas is treated as a by-product or waste product of oil production and is typically disposed of via venting or flaring to the environment.

Venting and flaring are relatively inexpensive ways to deal with associated gas, but result in relatively high emissions (e.g., large quantities of greenhouse gases) and fail to capture any of the energy contained within the associated gas. Improved flaring systems and methods have been developed to reduce flare emissions sufficiently to satisfy stringent emission standards, however, many of these improved flaring systems merely convert the energy within the associated gas into thermal energy that is passed to the environment and do not leverage the energy contained within the associated gas.

In some production operations, combustion generators are employed to consume associated gases and produce power (e.g., electrical power, mechanical power, etc.). Such approaches improve conversion efficiency and lower emissions but depend, at least in part, on the associated gas properties (e.g., pressure, composition, specific energy density, etc.). In particular, the associated gas properties must meet the operational parameters and specifications of the combustion generator. For instance, many combustion generators designed for hydrocarbon gases operate effectively with gases having a specific energy density between 350 Btu/scf and 1700 Btu/scf. If the hydrocarbon gas fueling the combustion generator has a specific energy density outside this operational range, the combustion generator may operate inefficiently or not at all. Since associated gas makeup within a well and across different wells can vary greatly, the usefulness of such combustion generator systems also varies.

Accordingly, there remains a need in the art for methods and systems to reduce oil production operation emissions resulting from associated gas while converting the energy contained in the associated gas into a more useful form (e.g., electrical or mechanical power). Such systems and methods would be particularly well received if they were designed and configured to accommodate associated gas of varying makeup and could be effectively utilized with associated gas having a specific energy density outside the operating range of conventional combustion generators.

BRIEF SUMMARY OF SOME OF THE PREFERRED EMBODIMENTS

These and other needs in the art are addressed in one embodiment by a system for controlling the emission of associated gas produced from a reservoir. In an embodiment, the system comprises a gas compressor including a gas inlet in fluid communication with an associated gas source and a gas outlet. The gas compressor adjusts the pressure of the associated gas to produce a pressure-regulated associated gas that exits the gas compressor through the gas outlet. In addition, the system comprises a gas cleaner including a gas inlet in fluid communication with the outlet of the gas compressor, a fuel gas outlet, and a waste product outlet. The gas cleaner separates at least a portion of the sulfur and the water from the associated gas to produce a fuel gas that exits the gas cleaner through the fuel gas outlet. Further, the system comprises a gas turbine including a fuel gas inlet in fluid communication with the fuel gas outlet of the gas cleaner and an air inlet, and a combustion gas outlet. Still further, the system comprises a choke in fluid communication with the air inlet and adapted to control the flow rate of air through the air inlet.

These and other needs in the art are addressed in another embodiment by a method of controlling the emission of an associated gas from an oil-producing well. In an embodiment, the method comprises flowing the associated gas from the well, wherein the associated gas has a specific energy density and includes hydrocarbons, sulfur, and water. In addition, the method comprises adjusting the pressure of the associated gas. Further, the method comprises removing at least a portion of the sulfur and water from the associated gas to produce a fuel gas. Still further, the method comprises flowing the fuel gas and air to a gas turbine. Moreover, the method comprises driving an electric generator with the gas turbine.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
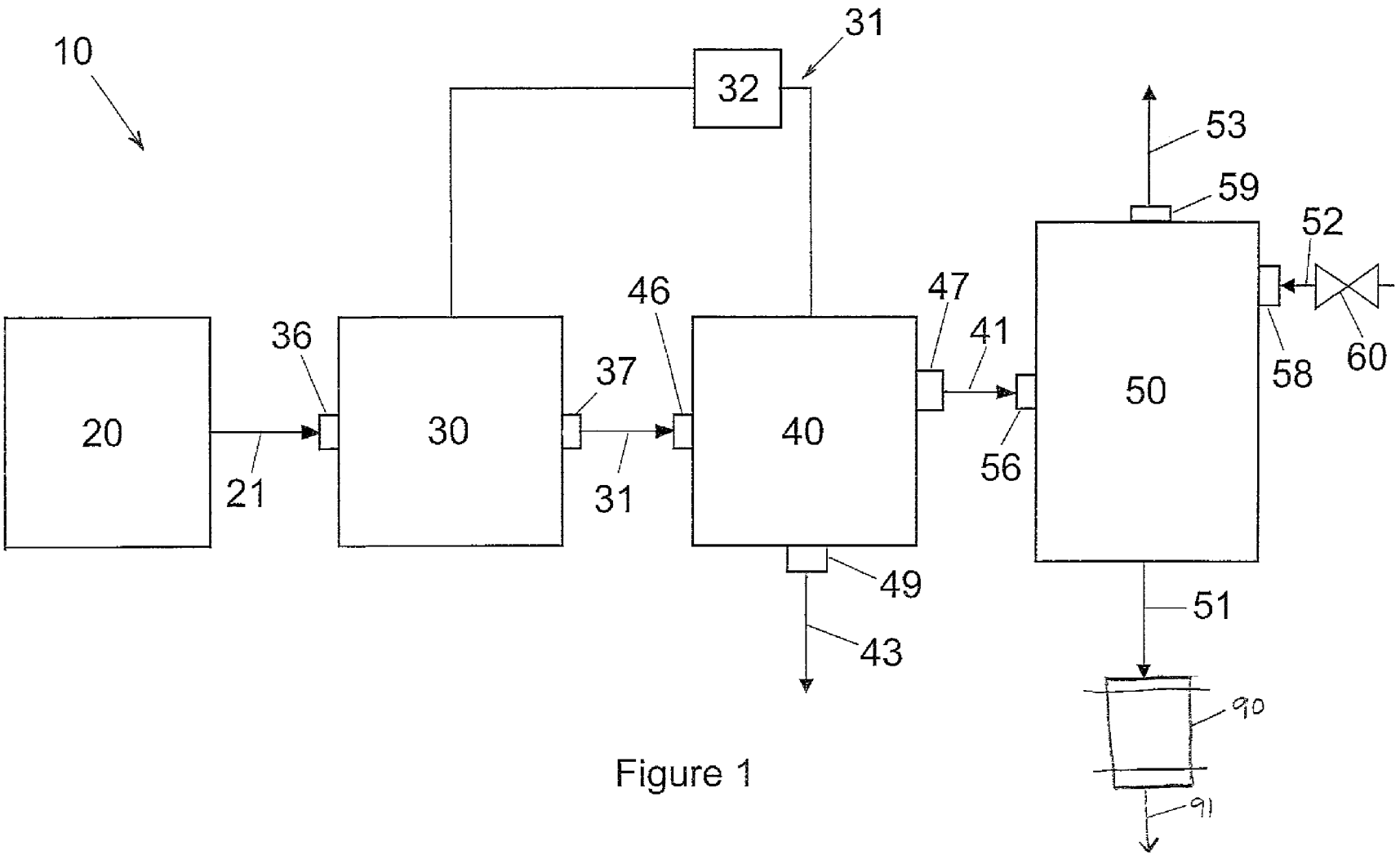
FIG. 1 is a schematic view of an embodiment of an associated gas emission control and power system in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form, and some details of conventional elements may not be shown in the interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices and connections.

Referring now to FIG. 1, an embodiment of an associated gas emission control and power generation system 10 is schematically shown. System 10 comprises an associated gas source 20, a gas compressor 30, a gas cleaner 40, and a gas turbine 50. In general, system 10 is employed to convert the energy stored in associated or casinghead gas into electrical energy while simultaneously reducing emissions to the environment from the associated gas.

Associated gas source 20 provides an associated gas 21 to system 10. Gas source 20 is typically an oil-producing well that produces associated gases 21 as a by-product of the oil extraction. As previously described, associated gas 21 can exist separate from the crude oil in the underground formation or be dissolved in the crude oil. In either case, associated gas 21 is released or separated from the produced crude oil upon extraction. The chemical makeup of associated gas 21 may vary from well to well, and may even vary over time for a particular well. Typically, associated gas 21 includes a mixture of hydrocarbon gases (e.g., methane, ethane, butane, etc.), hydrogen sulfide, carbon dioxide, and nitrogen, as well as some "wet" components such as water. Usually, the specific energy density of associated gas (e.g., associated gas 21) ranges from 100 Btu/scf to 2800 Btu/scf. As used herein, the term "specific energy density" may be used to refer to the amount of energy stored in the associated gas per unit volume of the associated gas, typically expressed in terms of BTU/scf.

In most conventional crude oil production operations, the associated gas occurring in conjunction with the produced crude oil is vented or flared (e.g., burned) to the atmosphere. Such venting or flaring results in relatively high emissions to the atmosphere and disposes of the associated gas without leveraging any of its stored potential energy. However, as is described in more detail below, in embodiments of system 10 described herein, associated gas 21 is not vented or flared, but rather, is passed along for further processing.

Associated gas 21 is provided to a gas compressor 30. In particular, gas compressor 30 includes a gas inlet 36 and a gas outlet 37. Inlet 36 is in fluid communication with gas source 20 via a pipe, conduit, or other suitable means. Thus, associated gas 21 is flowed from gas source 20 through gas inlet 36 and into gas compressor 30. Within gas compressor 30, the pressure of associated gas 21 is controlled and regulated to produce a pressure-regulated associated gas 31 having a pressure suitable for efficient energy conversion and minimal emissions.

Although the pressure of associated gas 21 from gas source 20 varies over time, it is typically between 0 lb/in.$^2$ and 25 lbs/in$^2$. However, the optimal pressure of associated gas 21 for efficient energy conversion and minimal emissions may be outside this range. Consequently, compressor 30 is provided to regulate and adjust the pressure of associated gas 31, real-time or periodically, to enhance the operational efficiency of system 10. In this exemplary embodiment, gas compressor 30 preferably produces a pressure-regulated associated gas 31 having a pressure between 50 lbs/in$^2$ and 100 lbs/in$^2$. The pressure-regulated associated gas 31 exits compressor 30 at outlet 37 and is flowed to a gas cleaner 40.

Gas cleaner 40 comprises a pressure-regulated associated gas inlet 46, a "clean" fuel outlet 47, and a waste outlet 49. Inlet 46 is in fluid communication with outlet 37 of compressor 30 via a pipe, conduit, or other suitable means. Thus, pressure-regulated associated gas 31 flows from outlet 37 of compressor 30 through inlet 46 into gas cleaner 40. Within gas cleaner 40, associated gas 31 is "cleaned" by separating some of the noncombustible components from the hydrocarbon gases in associated gas 31. In particular, sulfur (in the form of hydrogen sulfide) and water (liquid or vapor) are preferably separated from the hydrocarbon gases in pressure-regulated associated gas 31. Via this separation, associated gas 31 is divided generally into a "clean" fuel gas 41 comprising primarily hydrocarbon gases, and waste products 43, including at least sulfur and water. Waste products 43 exit gas cleaner 40 and system 10 via waste outlet 49. Waste products 43 may be disposed of or passed to another system for further processing. "Clean" fuel gas 41 exits gas cleaner 40 via fuel outlet 47 and flows to gas turbine 50 via a pipe, conduit, or other suitable means.

Gas cleaner 40 may comprise any suitable device for separating undesirable components from the associated gas (e.g., sulfur, sulfur-containing compounds, water, etc.) including, without limitation, a gas scrubber, filter system, absorber system, water knockout system, separator, or combinations thereof. Gas cleaner 40 may separate the undesirable waste products 43 from the fuel gas by any suitable means or method including, without limitation, scrubbing, stripping, separation filtering, absorption, or combinations thereof.

A pressure control feedback loop 31 is provided between gas compressor 30 and gas cleaner 40. Feedback loop 31 includes a pressure switch 32 that senses and monitors the pressure in gas-cleaner 40. In particular, pressure switch 32 has a predetermined and adjustable high pressure and low pressure set point. As pressure in gas cleaner 40 exceeds the high pressure set point of pressure switch 32, power (e.g., electricity) to compressor 30 is discontinued, and thus, compression of associated gas 21 and flow of associated gas 21, 31 decreases. As fuel gas 41 continues to flow from gas cleaner 40 and be consumed by gas turbine 50, the pressure in gas cleaner 40 will decrease. Once the pressure in gas-cleaner reaches the the low pressure set point of pressure switch 32, power to compressor 30 is reconnected, thereby reestablishing compression of associated gas 21 and flow of associated gas 21, 31. In this manner, the pressure and flow of fuel gas 41 from gas cleaner 40 may be controlled.

Referring still to FIG. 1, gas turbine 50 includes a "clean" fuel gas inlet 56 in fluid communication with outlet 47 of gas cleaner 40, an air inlet 58, and a spent fuel outlet 59. Fuel gas 41 flows from outlet 47 of gas cleaner 40 through fuel gas inlet 56 into gas turbine 50. Air 52 flows through air inlet 58 into gas turbine 50. The flow rate of air 52 into gas turbine 50 is controlled by a valve or choke 60. As will be explained in more detail below, gas turbine 50 converts the stored energy in fuel gas 41 into rotational energy and torque 51 which drives an electric generator 90 to produce electricity 91. Exhaust or combustion product gases 53, by-product of the energy conversion process, exit gas turbine 50 via spent fuel outlet 59.

Figure 2:
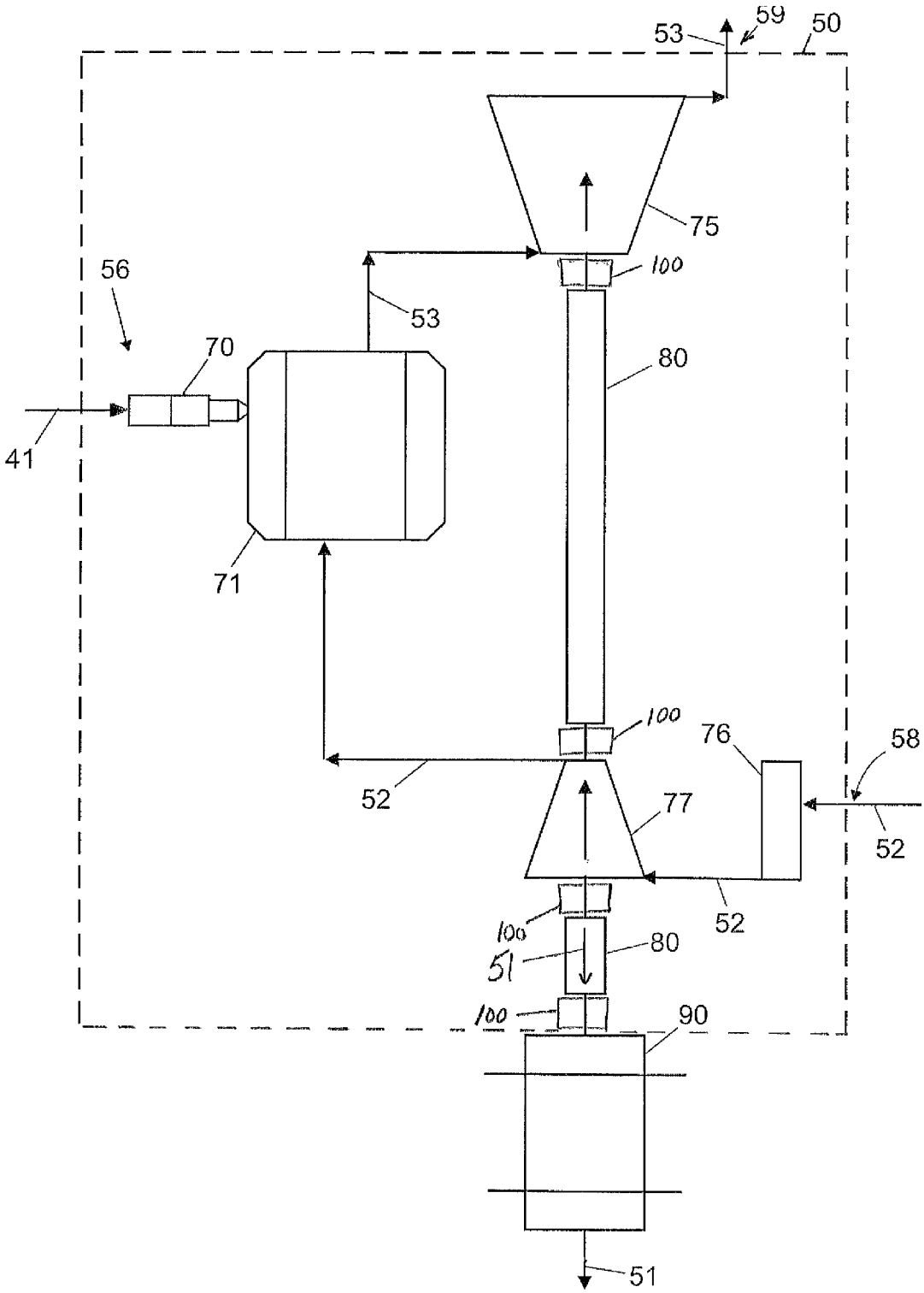
FIG. 2 is an enlarged schematic view of the microturbine of FIG. 1.

Referring now to FIGS. 1 and 2, gas turbine 50 includes a compressor 77, a combustion chamber 71 downstream of compressor 77, and a power turbine 75 downstream of combustion chamber 71. Compressor 77, combustion chamber 71, and power turbine 75 are in fluid communication. Further, compressor 77 and electric generator 90 are mechanically coupled to power turbine 75 by a driveshaft 80 supported by a plurality of bearings 100. Driveshaft 80 transfers rotational energy, power, and torque generated by power turbine 75 to compressor 77 and electric generator 90. Thus, power turbine 75 drives compressor 77 and electric generator 90.

In general, gas turbine 50 may comprise any suitable turbine. However, in this embodiment, gas turbine 50 is a gas microturbine. Further, in this embodiment, bearings 100 are air bearings that utilize a relatively thin film or layer of air to support driveshaft 80, and thus, provide a low or zero friction load-bearing interface. An example of a gas microturbine including air bearings is the low-emissions microturbine available from Capstone Microturbine Solutions of Chatsworth, Calif. The use of a gas microturbine with air bearings is preferred since gas microturbines provide a relatively small footprint, and offer the potential for a relatively high tolerance to contaminants common in the oil field, reduced maintenance (e.g., air bearings do not require periodic lubrication), and reduced emissions (e.g., no used oil disposal issues). Such characteristics are particularly suited for use in remote oil field sites. In addition, gas microturbines employing air bearings advantageously provide a lower firing temperature and reduced likelihood of turbine blade corrosion.

During operation of gas turbine 50, air 52 flows through air inlet 58 into gas turbine 50. As previously described, the flow rate of air 52 into gas turbine 50 is controlled by a valve or choke 60. Air 52 entering inlet 58 flows through an air filter 76 to remove undesirable particulate matter or airborne solids in air 52. Downstream of air filter 76, air 52 enters air compressor 77, which increases the pressure of air 52 just prior to its entry into combustion chamber 71. The compressed air 52 flows from compressor 77 into combustion chamber 71.

Simultaneous with the flow of air 52 into gas turbine 50, fuel gas 41 flows from outlet 47 of gas cleaner 40 through fuel gas inlet 56 into gas turbine 50. As best shown in FIG. 2, fuel gas 41 entering inlet 56 passes through a fuel injector 70 into combustion chamber 71. In this embodiment, fuel injector 70 is specifically designed to accommodate well head gas. In particular, to better accommodate well head gas, fuel injector 70 comprises an open-ended pipe that allows a greater fuel/air ratio local to the point of fuel injection as compared to a conventional injector, which generally mixes air and fuel within the injector by means of a distributor plate and provides a lower fuel/air ratio. In this embodiment, fuel injector 70 comprises a one inch open-ended pipe. Fuel injector 70 is preferably interchangeable such that it may be replaced with a different (e.g., larger or smaller diameter) fuel injector as desired. In this manner, the versatility of gas turbine 50 may be enhanced by modification for use with a variety of associated gas compositions.

In the manner previously described, fuel gas 41 and compressed air 52 are delivered to combustion chamber 71. Within combustion chamber 71, the fuel gas 41 and compressed air 52 at least partially mix, are ignited, and combust. Expanding combustion product gases 53 drive pass through and drive power turbine 75. The rotational energy, power, and torque generated by power turbine 75 are transferred to electric generator 90 via driveshaft 80, thereby producing electricity 91. The produced electricity 91 may be used (e.g., to power one or more electrical components within system 10), distributed to another locale, or stored for later use. In addition, as previously described, power turbine 75 is also coupled to, and drives, air compressor 77 previously described. Thus, expanding combustion gases 53 drive power turbine 75 which, in turn, drives air compressor 77 to compress air 52 and drives electric generator 90 to produce electricity 91. After expanding and passing through rotor-stator assembly 75, the combustion gases 53 are exhausted from system 10 to the environment via combustion gas outlet 59.

Referring still to FIGS. 1 and 2, in order to balance emissions from gas turbine 50 (e.g., quantity and composition of emissions) and the desired power output of gas turbine 50, the combustion process within combustion chamber 71 is preferably continuously controlled by continuously adjusting the pressure and flow rate of fuel gas 41 and compressed air 52 into combustion chamber 71. In this embodiment, the pressure of fuel gas 41 entering gas turbine 50 is controlled by the upstream air compressor 30, and the flow rate of fuel gas 41 is controlled by fuel injector 70 (e.g., the size of fuel injector 70). Further, in this embodiment, the flow rate of air 52 is controlled by choke 60, and the pressure of air 52 is controlled by air compressor 77 of gas turbine 50.

In embodiments where system 10 is used for controlling and reducing emissions, the flow rate and pressure of fuel gas 41 and air 52 are preferably adjusted to achieve an air-fuel ratio that provides more complete combustion. The appropriate or optimal air-fuel ratio will depend, at least in part, on the heating values of the fuel gas 41. As used herein, the phrase "heating value" may be used to describe the amount of heat released during the combustion of a specified volume of a fuel. Without being limited by this or any particular theory, because of the inefficiencies in combustion, the heating value of a fuel is typically less than the specific energy density of the fuel.

It should be appreciated that a variety of factors may influence the combustion process, quantity and characteristics of emissions from system 10, and the power output of gas turbine 50. Such factors include, without limitation, the composition of fuel gas 41, the specific energy density of fuel gas 41, the flow rate and pressure of fuel gas 41 entering combustion chamber 71, the flow rate and pressure of air 52 entering combustion chamber 71, conditions within combustion chamber 71, or combinations thereof. Such factors are preferably continuously monitored such that the flow rate and pressure of fuel gas 41 and the flow rate and pressure of air 52 may be continuously adjusted as previously described. Consequently, in some embodiments a plurality of sensors, a control system, and a feedback loop are employed to automatically monitor such factors and adjust the pressure and flow rate of fuel gas 41 and air 52 as appropriate to optimize the combustion process, quantity and characteristics of emissions from system 10, and the power output of gas turbine 50.

By regulating and controlling the flow rate and pressure of fuel gas 41 and the pressure and flow rate of air 52, the combustion efficiency of gas turbine 50 and the emissions from gas turbine 50 may be controlled. As compared to conventional venting or flaring, the controlled combustion within gas turbine 50 offers the potential for lower emissions. Still further, by regulating and controlling the flow rate and pressure of fuel gas 41 with compressor 30 and the fuel injectors, and controlling the pressure and flow rate of air 52 with choke 60 and the air compressor, system 10 offers the potential for a system that can effectively combust fuel gas 41 having a specific energy density outside the specifications of a conventional combustion generator. For instance, many conventional engine generators and conventional turbines require a fuel with a specific energy density between 350 Btu/scf and 1700 Btu/scf for efficient operation. However, by utilizing a gas turbine 50 and continuously controlling the flow rate and pressure of fuel gas 41 and air 52, embodiments of system 10 offer the potential to efficiently and effectively combust associated gas 21 having a specific energy density below 350 Btu/scf or above 1700 Btu/scf. In addition to lower overall emissions, system 10 enables the conversion of energy in associated gas 21 into useful electrical energy. Still further, as compared to some conventional engine generators, the use of gas turbine 50 within system 10 offers the potential for a relatively robust, simple (e.g., relatively few moving parts), and cost-effective emission control system and power generator for use in remote oil field sites.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A method of controlling emission of an associated gas from an oil-producing well comprising:

flowing the associated gas from the well, wherein the associated gas has a specific energy density below 350 Btu/scf or above 1700 Btu/scf and includes hydrocarbons, sulfur, and water;

compressing the associated gas, with a gas compressor, to an associated gas pressure in correspondence with a control input;

removing at least a portion of the sulfur and water from the associated gas to produce a fuel gas;

controlling the gas compressor to control a fuel gas pressure of the fuel gas;

flowing the fuel gas and air to a gas turbine;

choking an air flow into an air inlet of an air compressor of the gas turbine in association with the control input;

combusting the fuel gas and the air in the gas turbine in association with the control input; and driving an electric generator with combustion energy from the gas turbine by transmitting torque from the gas compressor to the electric generator via a driveshaft.

2. The method of claim 1 further comprising maintaining the pressure of the fuel gas within a predetermined pressure range.

3. The method of claim 2 wherein the pressure of the fuel gas is maintained with a pressure control feedback loop including a pressure switch that monitors the pressure of the fuel gas and adjusts the pressure of the associated gas.

4. The method of claim 3 wherein the pressure control feedback loop provides power to a gas compressor when the pressure of the fuel gas is within a predetermined range, and terminates power to the gas compressor when the pressure of the fuel gas is outside the predetermined range.

5. The method of claim 3 wherein the pressure of the associated gas is adjusted with a gas compressor before removing the at least a portion of the sulfur and water from the associated gas.

6. The method of claim 1 wherein the gas turbine comprises:

a combustion chamber that combusts the fuel gas and compressed air to produce combustion product gases;

an air compressor of the turbine that compresses the air flowed to the gas turbine and provides the compressed air to the combustion chamber;

a power turbine that is driven by the combustion product gases; and a driveshaft coupled to the power turbine, the air compressor of the turbine, and the electric generator, wherein the driveshaft is supported by a plurality of air bearings.

7. The method of claim 6 wherein the power turbine drives the electric generator with the driveshaft to produce electricity.

8. The method of claim 6 wherein the gas turbine comprises a fuel injector that controls a flow rate of the fuel gas to the combustion chamber.

9. The method of claim 6 further comprising adjusting the flow rate of the air and fuel gas entering the gas turbine based on the specific energy density of the associated gas.

10. The method of claim 6 further comprising adjusting the flow rate of the air entering the gas turbine to modify the air to fuel ratio in the combustion chamber.

11. The method of claim 10 wherein the flow rate of the air to the gas turbine is controlled by a valve and wherein the flow rate of the fuel gas is controlled by a fuel injector.

12. The method of claim 10 wherein the flow rate of the air to the gas turbine is controlled by a choke and wherein the flow rate of the fuel gas is controlled by a fuel injector.

* * * * *